US012607393B2

(12) United States Patent
Jędrzejczak

(10) Patent No.: US 12,607,393 B2
(45) Date of Patent: Apr. 21, 2026

(54) AIR-TO-WATER HEAT PUMP SYSTEM WITH DEFROSTING UNIT AND METHOD OF OPTIMIZING THE OPERATION OF THE AIR-TO-WATER HEAT PUMP

(71) Applicant: Marek Jędrzejczak, Raszyn (PL)

(72) Inventor: Marek Jędrzejczak, Raszyn (PL)

( * ) Notice: Subject to any disclaimer, the term of this patent is extended or adjusted under 35 U.S.C. 154(b) by 129 days.

(21) Appl. No.: 18/573,455

(22) PCT Filed: Jun. 22, 2022

(86) PCT No.: PCT/PL2022/050040

§ 371 (c)(1),
(2) Date: Dec. 22, 2023

(87) PCT Pub. No.: WO2022/271045

PCT Pub. Date: Dec. 29, 2022

(65) Prior Publication Data

US 2024/0288208 A1 Aug. 29, 2024

(30) Foreign Application Priority Data

Jun. 22, 2021 (PL) ..... 438230
Jun. 14, 2022 (PL) ..... 441486

(51) Int. Cl.
*F25B 47/02* (2006.01)
*F25B 41/22* (2021.01)
*F25B 49/02* (2006.01)

(52) U.S. Cl.
CPC ..... *F25B 47/02* (2013.01); *F25B 41/22* (2021.01); *F25B 49/02* (2013.01); *F25B 2339/047* (2013.01); *F25B 2347/021* (2013.01); *F25B 2600/2507* (2013.01)

(58) Field of Classification Search
CPC ..... F25B 47/02; F25B 47/022; F25B 47/025; F25B 49/02; F25B 41/22; F25B 41/20; F25B 2339/047; F25B 2347/021; F25B 2347/02; F25B 2600/2507
See application file for complete search history.

(56) References Cited

U.S. PATENT DOCUMENTS 5,680,898 A * 10/1997 Rafalovich ..... F25B 13/00 165/236
5,685,162 A 11/1997 Iritani et al.

FOREIGN PATENT DOCUMENTS

| | | |
|---|---|---|
| CN | 206347790 | 7/2017 |
| CN | 207963222 | 10/2018 |
| WO | WO 96/21130 | 7/1996 |

OTHER PUBLICATIONS

International Search Report and the Written Opinion Dated Nov. 16, 2022 From the International Searching Authority Re. Application No. PCT/PL2022/050040. (12 Pages).

* cited by examiner

*Primary Examiner* — Miguel A Diaz

(57) ABSTRACT

An air-to-water heat pump system is disclosed comprising a lower heat source unit and an upper heat source unit connected in a thermodynamic cycle, wherein the lower heat source unit is supplied with external air and the lower heat source has at least two alternating evaporators (1, 2) forming the lower heat source with a fan mounted axially in relation to the lower heat source unit in its upper part, provided with a defrosting unit in which it is possible to implement the defrosting and drying process of the evaporator heat exchange surface, as well as improve the energy efficiency of the heat pump system.

11 Claims, 4 Drawing Sheets

AIR-TO-WATER HEAT PUMP SYSTEM WITH DEFROSTING UNIT AND METHOD OF OPTIMIZING THE OPERATION OF THE AIR-TO-WATER HEAT PUMP

The present invention relates to an air-to-water heat pump with a defrosting unit and a method of optimizing the operation of the air-to-water heat pump, in particular the defrosting process. In air source heat pumps, due to the low temperature of the refrigerant in the evaporator, a layer of ice forms on the exchanger. The phenomenon of frosting of the exchanger usually occurs when the outside air temperature is below 7° C. Due to the high humidity of the outside air, water vapor condenses on the cold surface of the evaporator and freezes. Accumulation of ice layer reduces the air flow and causes the exchanger to lose its ability to exchange heat with the outside air. This leads to a significant drop in the efficiency of the evaporator and thus a drop in the efficiency of the entire heat pump system and its Coefficient of Performance (COP). Due to the periodic removal of the ice layer, the heat pump evaporator cannot run continuously. The number of defrosting cycles depends on the prevailing outdoor air conditions.

From the prior art a solution is known in which a medium with a higher thermodynamic potential is directed through the evaporator, the system is provided with a separate circuit containing a heat source for supplying the evaporator. The system is inactive during the defrosting process, and the condenser is not supplying heat.

A heat pump system is known from the prior art which uses an evaporator-condenser reversible operation for defrosting the exchanger. The system is provided with a four-way valve installed on the compressor inlet and outlet lines. The refrigerant flow in the circuit is reversed in order to defrost the evaporator. Changing the position of the four-way valve turns the evaporator into a condenser. In the defrosting process of the evaporator, the refrigerant gives off heat to the evaporator being defrosted, which acts as a condenser. Heat production is interrupted during the defrosting process. The heat pump, during periods of ice removal from the evaporator surface, works in a cooling mode, using energy taken from the operated system.

A heat pump system in known which uses the inclusion of an additional exchanger for reverse operation in order to defrost the evaporator, where the refrigerant circulation is controlled by two-way valves. EP 2 516 942 B1 describes a system including a solution for connecting an additional heat exchanger in series between the condenser and the evaporator. The additional exchanger works in a defrost mode reversely as an evaporator or as a condenser, depending on the position of the two-way valves. EP 0 128 108 B1 discloses the system comprises a plurality of exchangers connected in parallel to the circuit. The refrigerant flow configuration is changed by means of two-way valves. The system comprises, in order to defrost the exchanger, at least two reversible external exchangers operating alternately as an evaporator or as a condenser, where the circulation of the indoor unit is shut off during the defrost.

A heat pump system is known which uses two or more evaporators to be connected in series and to operate alternately for defrosting the exchanger. EP 1 598 611 discloses a heat pump system having two rows of evaporator working alternately in a defrost mode, wherein the system carries out the process using one or two four-way valves and two expansion valves. EP 2 447 096 A1 discloses a heat pump system provided for carrying out defrosting process with two evaporators operating alternately as subcooler/evaporator and two expansion valves and a four-way valve. Patent PL 209 839 B1 discloses a water heat pump comprising a condenser, a subcooler, one expansion element and a four-way valve for alternately reversing the direction of the refrigerant circuit in a defrost mode. Patent application P.430903 discloses a heat pump having a lower and upper heat source and one expansion element, wherein the lower heat source comprises a reversible evaporator and a subcooler working alternately to perform a defrosting process, wherein the refrigerant circuit is changed by means of a four-way valve.

A significant problem that has not been raised in the prior art is the lack of drying of the evaporator after the defrosting process, which causes the evaporator heat exchange surface to freeze again in a short time. The object of the solution according to the invention is to carry out the process of defrosting and drying the heat exchange surface of the evaporator, and also to improve the energy efficiency of the heat pump system.

The air-to-water heat pump system according to the invention comprises a lower heat source unit and an upper heat source unit connected in a thermodynamic cycle, wherein the lower heat source unit is supplied with external air, and the lower heat source unit has at least two working alternately evaporators forming the lower heat source unit with a fan mounted axially in relation to the unit in an upper part, provided with a defrosting unit. The unit is characterized in that the least two alternately working evaporators are connected to a set of valves comprising two pairs of motor-actuated three-way valves each evaporator, respectively, of the lower heat source unit provided with a shutter. The evaporators are connected in series in a closed circuit with a condenser. An outlet port of the first evaporator connects via a through hole of the second three-way valve with the suction side of a compressor, connected on a discharge side to the condenser, an outlet port of which connects via a bypass of the third three-way valve with an inlet of the second evaporator, wherein an outlet of the second evaporator is connected via a bypass of the fourth three-way valve with an expansion valve and via a through hole of a first three-way valve the outlet of the second evaporator connects with an inlet of the first evaporator. The outlet port of the second evaporator connects via a bypass of the second three-way valve with the suction side of the compressor, connected on the discharge side with the condenser, the outlet port of which connects via a through hole of the third three-way valve with the inlet of the first evaporator, wherein the outlet of the first evaporator is connected via a through hole of the fourth three-way valve with the expansion valve and via a bypass of the first three-way valve the outlet of the first evaporator connects with the inlet of the second evaporator. Each shutter is formed on the lower heat source unit to shield a frosted one of the evaporators going into a defrosting mode.

Preferably, said set of valves is provided with actuators connected to a controller for automatically changing a circuit direction of a refrigerant and changing functions of the evaporators.

Preferably, each shutter is connected with a controller for automatically directing the shutter to shield the evaporator being defrosted.

Preferably, each shutter is automatically directed to shield the evaporator being defrosted in a rotary or reciprocating motion in a horizontal or vertical direction, or by closing single or multi-blade dampers.

Preferably, the evaporators forming the lower heat source unit are finned bent or segmented exchangers shaped as an open or closed polygon, including a regular or irregular polygon, or as a plane or as a circle or semicircle or as some other irregular shape.

Preferably, each shutter is in the form of concentric semi-circles mounted on both sides of the evaporator, coaxially with the fan of the lower heat source unit.

Preferably, each shutter is in the form of a movable element shaped as a shield or a damper, adapted to change position by sliding means, mounted to the frame structure on both sides of the evaporator, the shutters have a configuration corresponding to the shape of the evaporator.

Preferably, each shutter consists of an inner and an outer part which are thermally insulated.

Preferably, the shutter parts are provided with a brush element arranged along a height of each shutter part, preventing external air from infiltrating into the space between the evaporator being defrosted and the shutter, while maintaining the free movement of the shutter.

Preferably, the closed circuit heats a water or glycol solution in the upper heat source unit.

The method of optimizing an operation of the air-to-water heat pump, which uses an alternating operation of at least two evaporators, is characterized in that a defrosting process of the second evaporator is carried out by directing a refrigerant from the first evaporator via a through hole of a second three-way valve to a compressor, then the refrigerant is directed to a condenser, then the refrigerant is directed via a bypass of the a three-way valve to the second evaporator, then the refrigerant is directed via a bypass of a fourth three-way valve to an expansion valve, then the refrigerant is directed via a through hole of a first three-way valve to the first evaporator, at the same time a shutter is directed to a position of shielding the second evaporator. A defrosting process of the first evaporator is carried out by directing the refrigerant from the second evaporator via a bypass of a second three-way valve to the compressor, then the refrigerant is directed to the condenser, then the refrigerant is directed via a through hole of the third three-way valve to the first evaporator, then the refrigerant is directed via a through hole of a fourth three-way valve to the expansion valve, then the refrigerant is directed via a bypass of a first three-way valve to the second evaporator, at the same time, the shutter is directed to a position of shielding the first evaporator to limit heat exchange between an outside air and the shielded first evaporator. A continuously operating fan forces the outside air to flow around the second evaporator. The defrosting process of one of said evaporators is carried out until an end of the defrosting cycle, wherein a controller, by switching an operating mode of the one of the three-way valves, generates another change of a refrigerant circulation direction, thus changing a functions of the evaporators and operating the shutter to the position of shielding the first or second evaporator that is being defrosted.

Thanks to the solution according to the invention, it is possible to implement the defrosting process of the air heat pump evaporator while maintaining high energy efficiency of the system. The reduction of power consumption to carry out the defrosting process results from the interaction of the system elements and the optimalization of its operation. The solution according to the invention makes it possible to carry out the defrosting process with absolute drying of the heat exchange surface of the evaporator. The use of a shutter ensures sublimation or melting ice process, heating the condensate and its subsequent evaporation. Thanks to the solution according to the invention, the number of defrosting cycles is reduced and the time interval between them is extended. On the wet surface of the heat exchanger the frost formation occurs again in a shorter time due to the presence of crystallization nuclei in the form of moisture droplets and impurities suspended in it. The solution according to the invention provides drying of the heat exchange surface, what, especially in sub-zero temperature conditions, is extremely important to extend the time of the exchanger operation in active mode. The present invention provide continuous operation of the heat pump in external conditions in which there is the phenomenon of an ice layer formation on the exchanger surface. The alternate operation of the lower heat source exchangers, provided by the automatically controlled set of valves and shutter according to the invention, guarantees the continuous operation of the heat pump system and a constant supply of heat energy to the upper heat source. High stability and reliability of the system allows to maintain the output temperature parameters required by the receiving system. No additional electric power is required to defrost the evaporator. The defrosting unit according to the invention allows recovery of energy from the process of defrosting the exchanger for subcooling the liquid refrigerant. The result of the above-mentioned set of technical features of the invention is a high year-round balance of thermal energy given off by the condenser, with a simultaneous lower power consumption, and therefore high energy efficiency of the system.

The present invention comprises an optimized lower heat source defrosting unit with a simplified structure. In the system according to the invention, the use of a shutter reduces the number of fans, so that the heat source system comprises one common fan for operating two heat exchangers. Furthermore, no additional expansion valves or heating circuits are used to carry out the defrosting process according to the invention. According to one of the preferred embodiments the cylindrical shape of the lower source unit according to the invention makes it possible to scale its size by increasing the diameter of the cylinder made of the set of evaporators and the fan, allowing the proportional adjustment of the system components to obtain the desired efficiency while maintaining the optimization of its structure.

The object of the invention is presented in an embodiment in the drawing, in which FIG. 1 shows a schematic diagram of a heat pump system for a configuration in which evaporator 2 is being defrosted and evaporator 1 is active;

EXAMPLE 1

Figure 1:
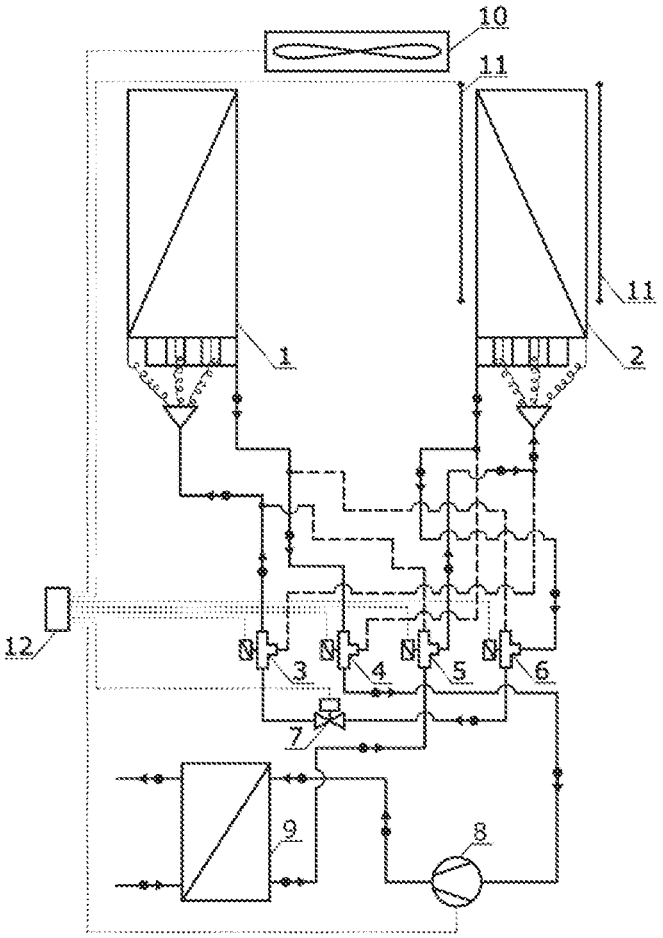

The air-to-water heat pump system according to the invention comprises a lower heat source unit and un upper heat source unit connected in a thermodynamic cycle, wherein the lower heat source unit is supplied with external air and the lower heat source unit has at least two alternately working evaporators 1, 2 forming the lower heat source unit with a fan 10 mounted axially in relation to the lower heat source unit in its an upper part, provided with a defrosting unit. The alternately working evaporators 1, 2 are connected to a set of valves comprising two pairs of motor-actuated three-way valves 3, 4 and 5, 6 each evaporator 1 and 2, respectively, of the lower heat source unit provided with a shutter 11. The evaporators 1, 2 are connected in series in a closed circuit with a condenser 9. An outlet port of the first active evaporator 1 connects via a through hole of the second three-way valve 4 with a suction side of the compressor 8, connected on a discharge side to the condenser 9, an outlet port of which connects via a bypass of the third three-way valve 5 with an inlet of the second evaporator 2 being defrosted, wherein an outlet of the second evaporator 2 (being defrosted) 2 is connected via a bypass of a fourth three-way valve 6 with an expansion valve 7 and via a through hole of a first three-way valve 3 the outlet of the second evaporator 2 it connects with an inlet of the first evaporator 1 (active). The outlet port of the second active evaporator 2 connects via a bypass of the second three-way valve 4 with the suction side of the compressor 8, connected on the discharge side with the condenser 9, the outlet port of which connects via a through hole of the third three-way valve 5 with the inlet of the first evaporator 1 (being defrosted), wherein the outlet from the first evaporator 1 (being defrosted) is connected via a through hole of the fourth three-way valve 6 with the expansion valve 7 and via a bypass of the first three-way valve 3 the outlet of the first evaporator 1 connects with the inlet of the second evaporator 2 (active). Each shutter 11 is formed on the lower heat source unit to shield a frosted one of the evaporators 1 or 2 going into defrosting mode. The set of valves is provided with actuators connected to a controller 12 for automatically changing a circuit direction of a refrigerant and changing functions of the evaporators 1 and 2. Each shutter 11 is connected with the controller 12 for automatically directing the shutter to a shield the evaporator being defrosted 1 or 2. The evaporators 1 and 2 forming the lower heat source unit are finned bent or segmented exchangers. Each shutter 11 consists of an inner and an outer part which are thermally insulated. The heat pump circuit heats the water or glycol solution in the upper heat source unit.

A method of optimizing an operation of an air-to-water heat pump, which uses an alternating operation of at least two evaporators 1,2 and a defrosting process of the second evaporator 2 is carried out by directing a refrigerant from the first active evaporator 1 via a through hole of a second three-way valve 4 to a compressor 8, then the refrigerant is directed to a condenser 9, then the (liquefied) refrigerant is directed via a bypass of a third three-way valve 5 to the second evaporator 2 (being defrosted), then the (subcooled) refrigerant is directed via a bypass of a fourth three-way valve 6 to an expansion valve 7, then the (expanded) refrigerant is directed via a through hole of a first three-way valve 3 to the first evaporator 1 (active), at the same time a shutter 11 is directed to a position of shielding the second evaporator 2 (being defrosted). A defrosting process of the first evaporator 1 is carried out by directing the refrigerant from the second active evaporator 2 via a bypass of a second three-way valve 4 to the compressor 8, then the refrigerant is directed to the condenser 9, then the (liquefied) refrigerant is directed via a through hole of a third three-way valve 5 to the first evaporator 1 (being defrosted), then the (subcooled) refrigerant is directed via a through hole of a fourth three-way valve 6 to the expansion valve 7, then the (expanded) refrigerant is directed via a bypass of a first three-way valve 3 to the second active evaporator 2, at the same time the shutter 11 is directed to a position of shielding the first evaporator 1 (being defrosted) to limit the heat exchange between an outside air and the shielded first evaporator 1 (being defrosted). A continuously operating fan 10 forces the outside air flow around the (exposed) second evaporator 2. The defrosting process of the first or second evaporator 1 or 2 is carried out until an end of the defrosting cycle, wherein a controller 12, by switching an operating mode of the one of the three-way valves, generates another change of a refrigerant circulation direction, thus changing a functions of the evaporators 1 or 2 and operating the shutter 11 to the position of shielding the first or second evaporator 1 or 2 that is being defrosted.

EXAMPLE 2

Figure 2:
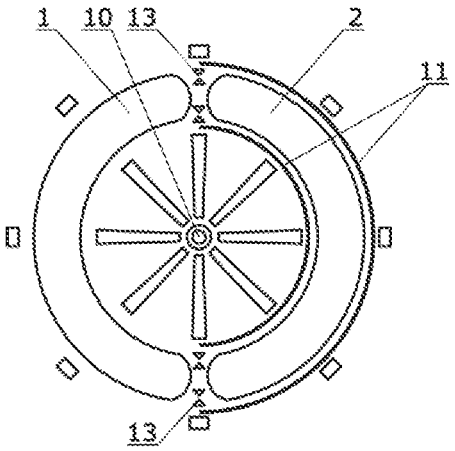
FIG. 2 shows a schematic plan view of the heat pump system according to the embodiment 2.

The heat pump system and the method of optimizing the operation of the air-to-water heat pump as in Example 1, except that:

The alternately working evaporators 1, 2 are shaped as semi-circles forming the lower heat source unit of a cylindrical unit shape with the fan 10 mounted axially in relation to the lower heat source unit in its upper part. Each shutter 11 is in the form of concentric semi-circles mounted on both sides of the evaporator 1, 2, coaxially with the fan 10 of the lower heat source unit. The parts of shutter 11 are provided with a brush element 13 arranged along a height of each shutter part, preventing external air from infiltrating into the space between the evaporator being defrosted and the shutter 11, while maintaining the free movement of the shutter 11. The shutter 11 is automatically directed to shield the evaporator being defrosted, in a rotary motion (FIG. 2).

EXAMPLE 3

Figure 3:
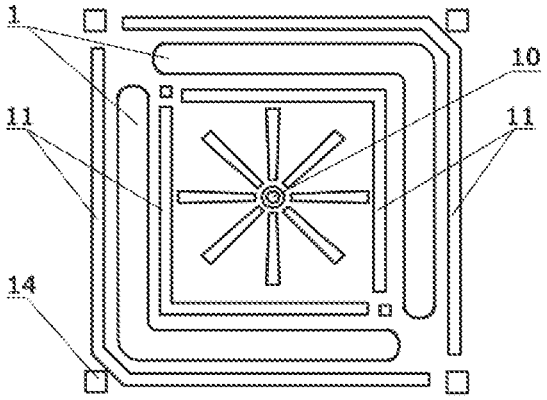
FIG. 3 is a schematic cross section of the top of the heat pump system of embodiment 3.
Figure 4:
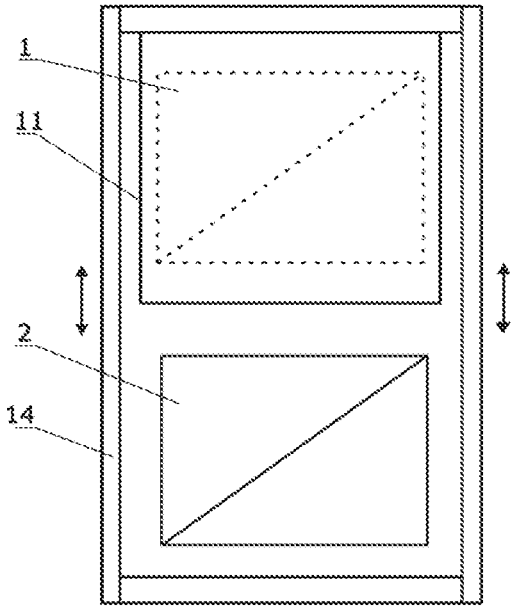
FIG. 4 is a schematic side view of the heat pump according to embodiment 3.

The heat pump system and the method of optimizing the operation of the air-to-water heat pump as in Example 1, except that:

The alternately working evaporators 1, 2 are shaped as closed polygons forming a the lower heat source unit of a cuboidal unit shape with the fan 10 mounted axially in relation to a lower heat source assembly in its upper part. The evaporator 1 is located at the top of the lower heat source assembly and evaporator 2 is located at its bottom. The shutter 11 is in the form of a movable element in the form of a shield, adapted to change position via sliding means, mounted to a frame structure 14 on both sides of the evaporator 1, 2, wherein the shutter 11 has a shape corresponding to the shape of the evaporator 1, 2. The automatic orientation of the shutter 11 at position of shielding the defrosted evaporator 1 or 2 takes place in a reciprocating movement in the vertical direction (FIG. 3 and FIG. 4).

EXAMPLE 4

The heat pump system and the method of optimizing the operation of the air-to-water heat pump as in Example 1, except that:

The heat pump circuit uses a natural refrigerant propane R290, wherein it was assumed that evaporator 2 is being defrosted and evaporator 1 is active. The compressor 8 compress the refrigerant (process 1-2 in FIG. 5) in the amount of 300 kg/h which in the condenser 9 being the upper heat source transfers to the heating system a power of 37.9 kW (process 2-3 in FIG. 5). The (liquefied) refrigerant with a temperature of 47° C. is directed to the evaporator 2 being defrosted, where it is subcooled to 5° C. (process 3-4), which increases the specific cooling capacity by 115 kJ/kg, while providing, at the same time, a heating power of 9.5 kW to the evaporator being defrosted 2, which ensures the sublimation of the ice layer. After subcooling, the refrigerant is throttled in the expansion valve (process 4-5) and then directed to the evaporator where it evaporates, recovering heat from the environment (process 5-1). In a preferred embodiment, a the (liquid) refrigerant having a temperature of 47° C. is directed to the evaporator 2 covered by the shutter 11. Due to the lack of heat exchange with the environment, which is achieved by the use of said shutter 11, the heat of subcooling the refrigerant is gradually transferred to the evaporator being defrosted 2, and then to the melting of the ice layer. Under conditions of low outside temperature, equal to 0° C., and high relative air humidity, equal to 100%, a layer of frost equal to 17.2 kg forms on the surface of one of the evaporators 1, 2 within 1 hour. In a preferred embodiment, said evaporator 1, 2 of the system according to the invention has a finned part mass of 48 kg, of which copper is 22 kg and aluminium is 26 kg. According to the calculations above and due to the fact that the specific heat of copper is 0.38 kJ/(kg*K) and aluminium is 0.9 kJ/(kg/*K), respectively, the amount of heat needed to heat the heat exchanger to the defrosting end temperature, equal to 5° C., is 290 kJ. At the same time, the amount of heat needed to melt the entire frost layer, taking into account the heat of fusion at the level of 333 kJ/kg, will be 5700 kJ. The mass of melted frost, equal to 57%, flows from the surface of the heat exchanger and flows out of the system. The residual, of 43%, mass of the melted frost in the form of a moisture layer thick about 100 μm remains on the surface of the evaporator 1, 2. The partial pressure of the saturated water vapor at the temperature 0° C., and thus the frost melting temperature, is 612 Pa. The moisture exchange takes place according to the partial pressure difference between the water layer wetting the heat exchange surface and the surrounding air. Effective drying of the heat exchange surface requires that the partial pressure of water vapor on the heat exchanger surface is higher than the water vapor pressure in the surrounding air. Accordingly, the surface of the evaporator being defrosted 2 is heated to a temperature of at least 5° C., at which the water vapor pressure at the surface of said exchanger is 873 Pa. The obtained partial pressure difference of at least 260 Pa allows the surface of the evaporator 2 to be dried by evaporating the remaining moisture on its surface.

Figure 6:
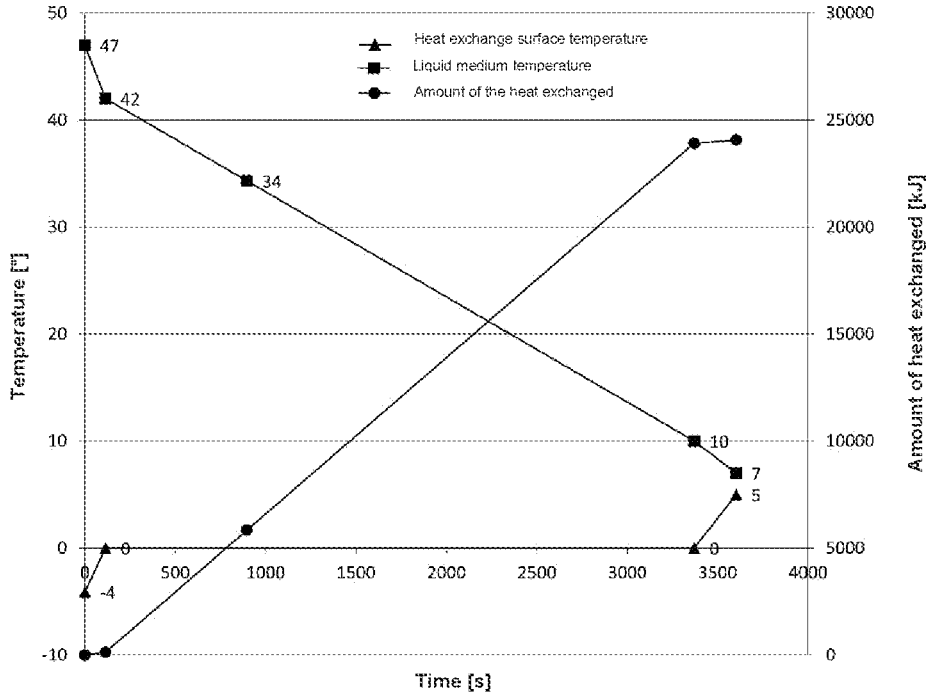
FIG. 6 shows the curve of the temperature change of the liquid refrigerant in the defrosting process, the temperature of the heat transfer surface and the amount of exchanged heat as a function of temperature and time, carried out the heat pump, for a preferred embodiment of the system and method according to example 4.

The curve of the temperature change of the (liquid) refrigerant in the defrosting process of the evaporator 2, according to FIG. 6, is as follows: The (liquid) refrigerant having a temperature of 47° C. flowing from the condenser 9 heats the heat exchanger, transferring during 115 s an amount of heat equal to 130 kJ, which causes heating of the heat exchanger from −4° C. to 0° C., which allows to start the process of melting the frost layer, while reducing the refrigerant temperature 42° C. The process of melting the frost layer is completed after 780 s after the refrigerant transfers 5700 kJ of heat, which reduces the temperature of the refrigerant to 34° C. Part of the melted frost flows down as condensate, while the remaining part, equal to 57%, wets the heat exchanger surfaces. This layer is evaporated thanks to the supply of another 18070 kJ of heat during 2470 s, which at the same time reduces the temperature of the (liquid) refrigerant to 10° C. The defrosting cycle ends after the refrigerant supplies another 160 kJ of heat, during 230 s, which heats the heat exchange surface to 5° C., which ensures the drying of the heat exchanger surface and at the same time prevents deposition of moisture. The total defrost time is 3600 s.

Figure 5:
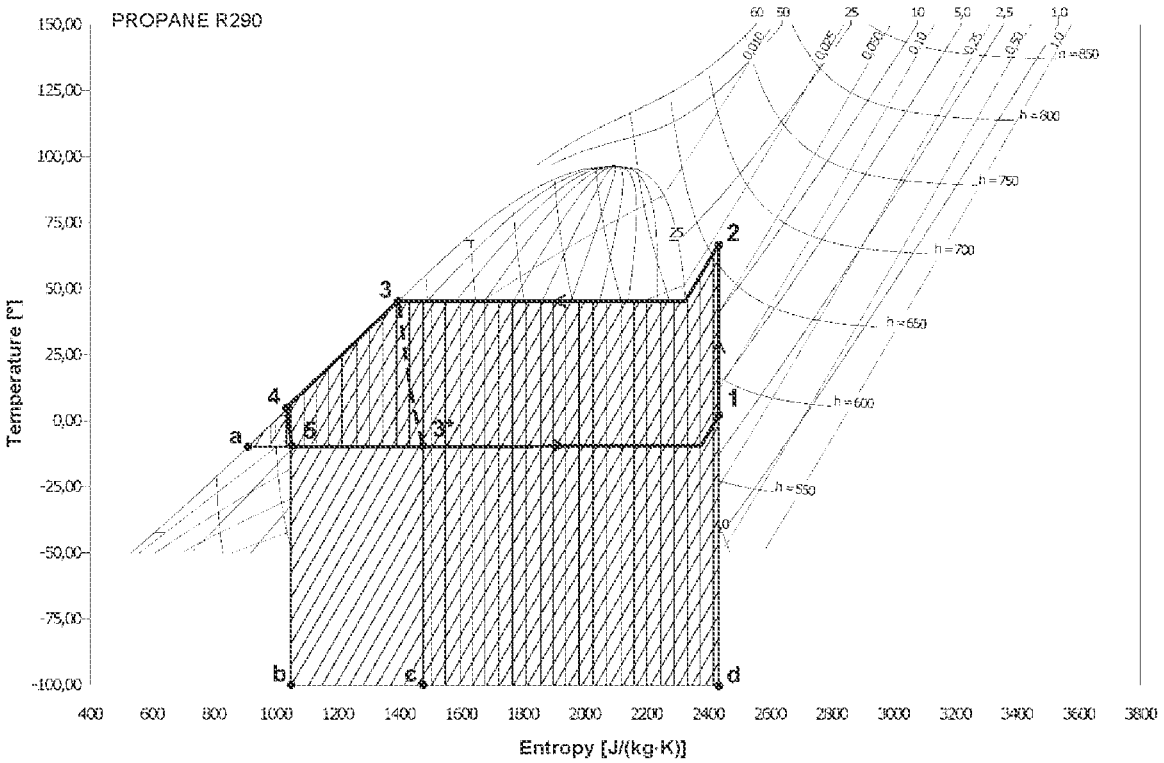
FIG. 5 shows a temperature-entropy diagram of a cooling circuit provided by the heat pump for a preferred embodiment of the system and method according to example 4.

FIG. 5 shows the advantageous effect of the invention in the form of increasing the heat pump heating power. The heat flux transferred by the device to the heating system in relation to the time unit is equal to the surface area under the curve marked with diagonal hatching, i.e. the area defined by points 2-3-a-5-b-d. This area is significantly larger than the area marked with vertical hatching, defined by points 2-3-a-3*-c-d, which is a graphical representation of the heat pump heating power without defrosting in favour of subcooling the (liquid) refrigerant, i.e. heat pumps with a defrosting system known in the prior art. It should be emphasized that the increase of the heat pump heating power according to the invention achieved by the use of the shutter takes place without increasing the work required for the implementation of the circuit, described as the surface area determined by points 1-2-3-a.

Figure 7:
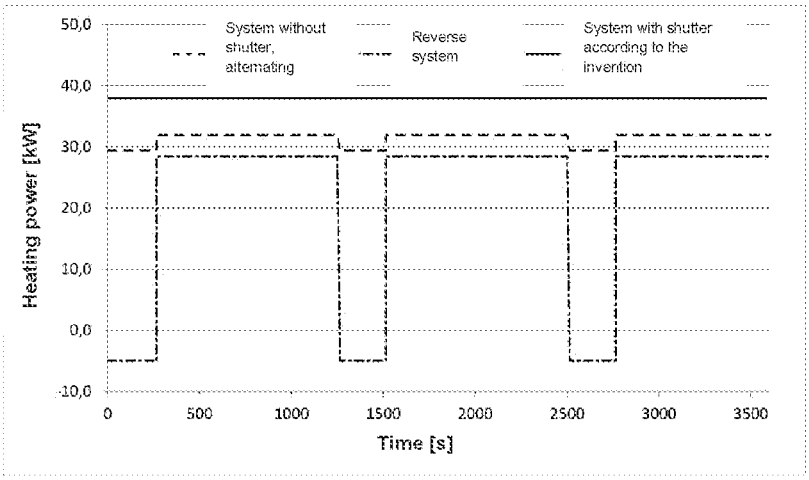
FIG. 7 shows a diagram of the heating power of the device over 1 hour for the alternating system without a shutter, the reversing system and the system with a shutter according to the invention.

FIG. 7 shows a further advantageous effect of the invention. As shown in the diagram, the heat pump according to the invention transmits a constant heating power to the receiving system. Unlike in the reversible system and the system without a shutter, in which there is a periodic reduction or even a negative heat flux transferred to the heating system.

An analysis of the technical parameters of the exemplary variant 4 shows that the air-to-water heat pump system according to the invention with a defrosting unit enables an energy-efficient implementation of the defrosting process. The shutter according to the invention enhances the defrosting effect, reducing the amount of energy and time required to complete the process. The use of the shutter according to the invention allows for an absolute drying of the exchanger being defrosted due to the maintenance of a higher temperature of the exchanger surface, and thus ensures a longer time of its operation in active mode.

THE LIST OF REFERENCES

1 first evaporator
2 second evaporator
3 first three-way valve
4 second three-way valve
5 third three-way valve
6 fourth three-way valve
7 expansion valve
8 compressor
9 condenser
10 fan
11 shutter
12 controller
13 brush element
14 frame structure

The invention claimed is:

1. An air-to-water heat pump system comprising a lower heat source unit and an upper heat source unit connected in a thermodynamic cycle, wherein the lower heat source unit is supplied with external air and the lower heat source unit has at least two alternately working evaporators (1, 2) forming the lower heat source of unit with a fan mounted axially in relation to the lower heat source unit in an upper part, provided with a defrosting unit wherein the at least two alternately working evaporators (1, 2) are connected to a set of valves comprising two pairs of motor-actuated three-way valves (3, 4) and (5, 6) each evaporator (1) and (2) of the lower heat source unit provided with a shutter (11), wherein the evaporators (1, 2) are connected in series in a closed circuit with a condenser (9);

wherein an outlet port of the first evaporator (1) connects via a through hole of the second three-way valve (4) with a suction side of a compressor (8), connected on a discharge side to the condenser (9), an outlet port of which connects via a bypass of the third three-way valve (5) with an inlet of the second evaporator (2), wherein an outlet of the second evaporator (2) is connected via a bypass of the fourth three-way valve (6) with an expansion valve (7) and via a through hole of the first three-way valve (3) the outlet of the second evaporator connects with an inlet of the first evaporator (1);

wherein the outlet port of the second evaporator (2) connects via a bypass of the second three-way valve (4) with the suction side of the compressor (8), connected on the discharge side with the condenser (9), the outlet port of which connects via a through hole of the third three-way valve (5) with the inlet of the first evaporator (1), wherein the outlet of the first evaporator (1) is connected via a through hole of the fourth three-way valve (6) with the expansion valve (7) and via a bypass of the first three-way valve (3) the outlet of the first evaporator (1) connects with the inlet of the second evaporator (2);

wherein each shutter (11) is formed on the lower heat source unit to shield a frosted one of the evaporators (1, 2) going into defrosting mode.

2. The heat pump system according to claim 1, wherein said set of valves is provided with actuators connected to a controller (12) for automatically changing a circuit direction of a refrigerant and changing the functions of the evaporators (1) and (2).

3. The heat pump system according to claim 1, wherein each shutter (11) is connected with a controller (12) for automatically directing the shutter to shield the evaporator being defrosted (1) or (2).

4. The heat pump system according to claim 1, wherein each shutter (11) is automatically directed to shield the evaporator being defrosted (1) or (2) in a rotary or reciprocating motion in a horizontal or vertical direction, or by closing single or multi-blade dampers.

5. The heat pump system according to claim 1, wherein the evaporators (1) and (2) forming the lower heat source unit are finned bent or segmented exchangers shaped as an open or closed polygon, including a regular or irregular polygon, or as a plane or as a circle, semicircle, or other irregular shape.

6. The heat pump system according to claim 1, wherein each shutter (11) is in the form of concentric semi-circles mounted on both sides of the evaporator (1, 2), coaxially with the fan (10) of the lower heat source unit.

7. The heat pump system according to claim 1, wherein each shutter (11) is in the form of a movable element shaped as a shield or damper, adapted to change position by sliding means, mounted to the frame structure (14) on both sides of the evaporator (1, 2), wherein the shutters (11) have a configuration corresponding to the shape of the evaporator (1, 2).

8. The heat pump system according to claim 1, wherein each shutter (11) consists of an inner and an outer part which are thermally insulated.

9. The heat pump system according to claim 8, wherein the shutter (11) parts are provided with a brush element (13) arranged along a height of each shutter part, preventing external air from infiltrating into the space between the evaporator being defrosted and the shutter, while maintaining free movement of the shutter (11).

10. The heat pump system according to claim 1, wherein the closed circuit heats a water solution or a glycol solution in the upper heat source unit.

11. A method of optimizing an operation of the air-to-water heat pump, which uses an alternating operation of at least two evaporators (1, 2), wherein a defrosting process of the second evaporator is carried out by directing a refrigerant from the first evaporator (1) via a through hole of a second three-way valve (4) to a compressor (8), then the refrigerant is directed to a condenser (9), then the refrigerant is directed via a bypass of a third three-way valve (5) to the second evaporator (2), then the refrigerant is directed via a bypass of a fourth three-way valve (6) to an expansion valve (7), then the refrigerant is directed via a through hole of a first three-way valve (3) to the first evaporator (1), at the same time a shutter (11) is directed to a position of shielding the second evaporator (2);

wherein a defrosting process of the first evaporator (1) is carried out by directing the refrigerant from the second evaporator (2) via a bypass of the second three-way valve (4) to the compressor (8), then the refrigerant is directed to the condenser (9), then the refrigerant is directed via a through hole of the third three-way valve (5) to the first evaporator (1), then the refrigerant is directed via a through hole of the fourth three-way valve (6) to the expansion valve (7), then the refrigerant is directed via a bypass of the first three-way valve (3) to the second evaporator (2), at the same time the shutter (11) is directed to a position of shielding the first evaporator (1) to limit the heat exchange between an outside air and the shielded first evaporator (1);

wherein a continuously operating fan (10) forces the outside air to flow around the second evaporator (1) or (2);

wherein the defrosting process of the first or second evaporator (1) or (2) is carried out until an end of the defrosting cycle, wherein a controller (12), by switching an operating mode of the one of the three-way valves, generates another change of a refrigerant circulation direction, thus changing a functions of the evaporators (12) and operating the shutter (11) to the position of shielding the first or second evaporator that is being defrosted (1) or (2).

* * * * *